United States Patent [19]

Larson et al.

[11] Patent Number: 4,936,894

[45] Date of Patent: Jun. 26, 1990

[54] PUSHBUTTON LOCK

[75] Inventors: Wayne F. Larson, Salem; John J. Risko, Cottage Grove, both of Oreg.

[73] Assignee: Supra Products, Inc., Salem, Oreg.

[21] Appl. No.: 397,128

[22] Filed: Aug. 21, 1989

Related U.S. Application Data

[63] Continuation of Ser. No. 120,584, Nov. 13, 1987, abandoned.

[51] Int. Cl.[5] ..... E05B 37/16

[52] U.S. Cl. ..... 70/298; 70/315

[58] Field of Search ..... 70/298, 162, 214, 220, 70/315–318, 324, 326, 299

[56] References Cited

U.S. PATENT DOCUMENTS

| | | | |
|---|---|---|---|
| 656,157 | 8/1900 | Alm | 70/298 |
| 1,085,894 | 2/1914 | Eagle | 70/298 |
| 1,343,459 | 6/1920 | Lacy | 70/162 |
| 1,374,769 | 4/1921 | Schicke | 70/299 |
| 1,534,836 | 4/1925 | Brede et al. | 70/162 |
| 3,099,150 | 7/1963 | Check | 70/214 |
| 3,115,028 | 12/1963 | Windle | 70/288 |
| 3,357,216 | 12/1967 | Cook . | |
| 3,397,046 | 2/1976 | Wang | 70/81 |
| 4,626,007 | 12/1986 | Larson | 292/65 |
| 4,748,833 | 6/1988 | Nagasawa | 70/214 |

FOREIGN PATENT DOCUMENTS

| | | | |
|---|---|---|---|
| 152359 | 6/1904 | Fed. Rep. of Germany | 70/298 |
| 2003337 | 8/1970 | Fed. Rep. of Germany | 70/298 |
| 493535 | 4/1954 | Italy | 70/288 |
| 227882 | 4/1969 | U.S.S.R. | 70/298 |

*Primary Examiner*—Lloyd A. Gall

*Attorney, Agent, or Firm*—Klarquist, Sparkman, Campbell, Leigh & Whinston

[57] ABSTRACT

A lock includes a plurality of elongated buttons, each of which has on the sides thereof a plurality of gates spaced angularly and longitudinally from one another. A case contains the lock and defines a plurality of bores within which the buttons travel. The buttons are urged out a front cover of the case by biasing springs and are normally prevented from rotation by engagement with keying protrusions on the case. The lock includes a locking bolt which is coupled to a checker plate. The checker plate defines a plurality of edges that engage the sides of the buttons and are received in the gates therein only if the buttons are properly positioned.

2 Claims, 8 Drawing Sheets

PUSHBUTTON LOCK

Related Application Data

This application is a continuation of co-pending application Ser. No. 07/120,584, filed Nov. 13, 1987, abandoned, the disclosure of which is incorporated herein by reference.

FIELD OF THE INVENTION

The present invention relates generally to locks, and more particularly to pushbutton locks having opening codes defined by the orientations of their pushbuttons.

BACKGROUND AND SUMMARY OF THE INVENTION

Locks in which an opening code is entered by operating a plurality of buttons in a predetermined pattern have long been known in the art. Examples of such locks are shown in U.S. Pat. Nos. 3,357,216 to Cook and 3,937,046 to Wang. Such locks, however, suffer from a variety of disadvantages. It is a principal object of the present invention to overcome the disadvantages found in the prior art and to provide a pushbutton lock having advantages not heretofore obtained.

According to the present invention, there is provided a lock having a plurality of elongated buttons, each of which has a first latching member and defines on the sides thereof a plurality of gates spaced angularly and longitudinally from one another. A case contains the lock and defines a plurality of bores within which the buttons travel. The buttons are urged out a front cover of the case by biasing springs. A plurality of second latching members cooperate with the first latching members for latching the buttons in a second, depressed position against the force of the biasing springs when the buttons are pushed in by an operator of the lock.

The lock includes a locking bolt which is coupled to a checker plate. The checker plate defines a plurality of edges that engage the sides of the buttons and are received in the gates therein if the buttons are properly positioned. The checker plate is slidably mounted in a track within the case and is normally urged to a first end of the track by another biasing spring. When the checker is at this first end of its travel, the bolt is in its locking position.

A knob is coupled to the checker plate and can be operated to urge the checker plate towards a second end of its track. However, the checker plate is prevented from moving to the second end of its track if the portions of the buttons engaged by the edges of the checker plate do not include gates. By this arrangement, all of the buttons must be properly positioned, both angularly and longitudinally, if the checker plate is to be moved to its second position so as to move the bolt to the unlocking position. The provision of ten button assemblies in the illustrated embodiment yields a total of 1024 possible opening combinations, with each additional button that may be added further doubling this number.

These and other objects, features and advantages of the present invention will be more readily apparent from the following detailed description, which proceeds with reference to the accompanying drawings.

DETAILED DESCRIPTION OF THE ILLUSTRATED EMBODIMENT

Figure 1:
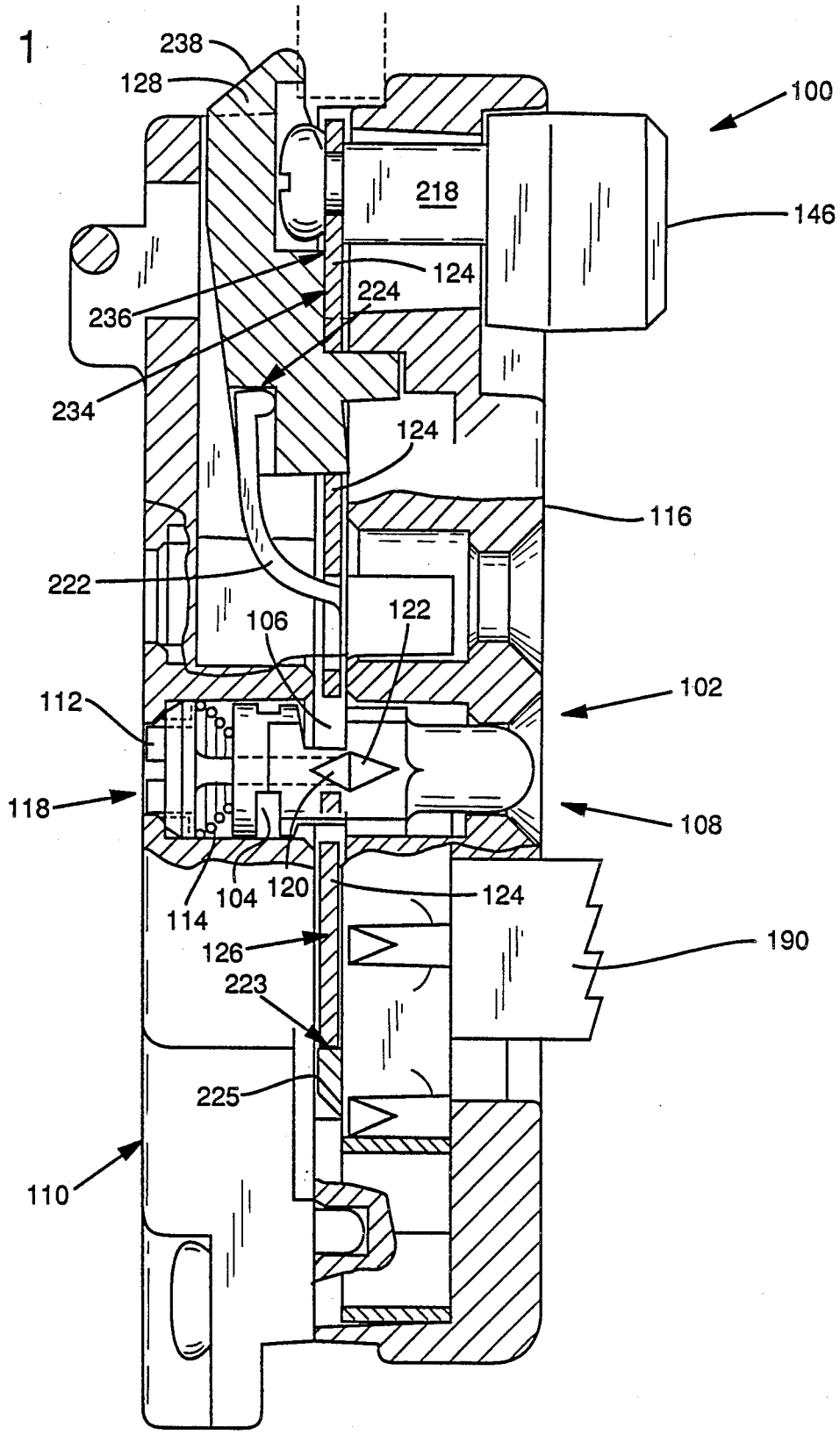
FIG. 1 is a side view, partially in section, showing a lock according to the present invention.

Referring generally to FIGS. 1–40, a lock 100 according to the present invention includes a plurality of elongated button elements 102 of substantially cylindrical shape. Into each button element 102 are cut two slots or gates 104, 106, positioned on opposite sides of the button at different positions along its length.

Button elements 102 are mounted for travel in bores 108 within the lock's case 110 and receive in the rear portions thereof indicator elements 112. Springs 114 bias button elements 102 from indicator elements 112, thereby urging the buttons out through a front cover 116 of the lock to their "out" positions. The combination of a button element 102, an indicator element 112 and a spring 114 is termed herein a button assembly 118. When depressed by an operator, each button element 102 is held in its "in" position by cooperation between a latching member 120 on the button and a corresponding latching member 122 inside the case.

Lock 100 includes a "checker plate" 124 which is slidably mounted in a track 126 within case 110 and coupled to a locking bolt 128. Checker plate 124 is biased by a spring towards a first end 132 (FIG. 15) of its travel, in which position associated bolt 128 is in its locked position. For bolt 128 to be moved to its unlocked position, checker plate 124 must be slid a short distance towards a second, opposite end 134 of its travel. This movement, however, is normally prevented by the checker plate's engagement with the sides of button elements 102.

For checker 124 to be moved towards its second end of travel 134, the button elements 102 adjacent the checker must all be positioned so that each presents a gate into which the advancing portion of the checker can be received. If all of button elements 102 are so oriented, checker 124 will be able to slide sufficiently far towards its second end of travel 134 to retract bolt 128 to its unlocked position. If, however, even one of button elements 102 is not so oriented, the corresponding portion of checker 124 will encounter the side of the button and be prevented from retracting the bolt to its unlocked position.

Gates 104 and 106 on each button element 102 are spaced from one another so that one gate or the other will always be in the plane defined by track 126 in which checker 124 slides, regardless of whether the button is in its "in" or "out" position. That is, the distance between the gates on each button matches the distance between the "in" and "out" positions of the buttons in the lock. The critical parameter that thus determines whether the button will present a gate into which the checker can slide is the button's angular orientation within its bore 108. This orientation is set from the rear of the lock and allows a user to combinate the lock to a desired opening code by turning button assemblies 118 to the desired orientations.

Figure 3:
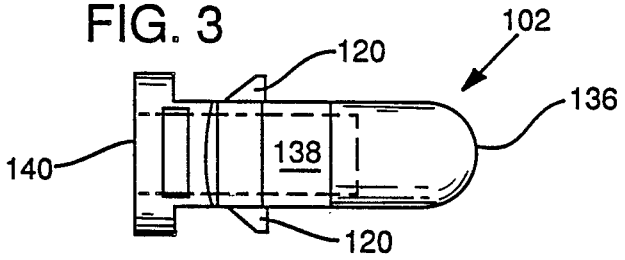
FIG. 3 is a side view of the button element of a button assembly.
Figure 5:
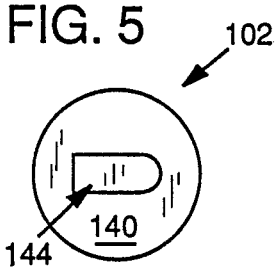
FIG. 5 is a rear view of the button element of a button assembly showing the splining hole into which the indicator element of the button assembly is inserted.
Figure 4:
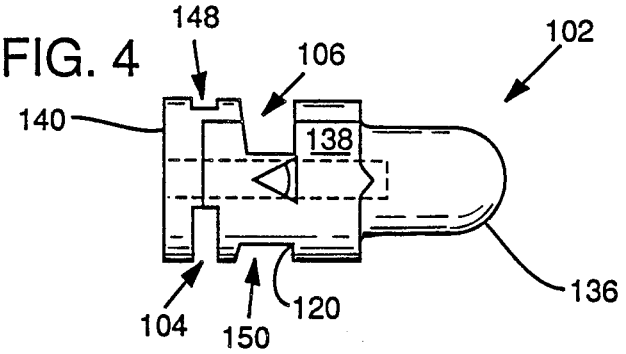
FIG. 4 is a side view of the button element of a button assembly orthogonal to the view shown in FIG. 3.

Turning now to the details of the lock's construction, button element 102 of button assembly 118 is shown in FIGS. 3–5 and includes a rounded front portion 136, a body portion 138 and a flat end 140. Rounded front portion 136 protrudes through a hole 142 in front cover 116 of the lock when button assembly 118 is in its normal, "up," position. Front portion 136 can be rounded so that when button assembly 118 is in its depressed position, the front portion cannot readily be gripped and pulled, as by pliers or the like, in an attempt to pick the lock. Into flat end 140 is cut a splined hole 144 (FIG. 5) into which the indicator element 112 of button assembly 118 is inserted. End 140 is desirably flat to provide a surface against which spring 114, which biases button element 102 from indicator element 112, can operate. Spring 114 is desirably tapered so as to minimize the distance separating button element 102 from indicator element 112 when the intervening spring is fully compressed.

Body portion 138 of button element 102 includes notches, or gates, which determine the locked or unlocked status of the lock. A first, rear gate 104 is cut into the side of body portion 138 near its rear end and comprises a slot approximately 0.045 inches in width and 0.100 inches in depth. On the opposite side of body portion 138, nearer the front end thereof, is cut a second, front gate 106 which comprises a bevelled slot having an outer width of approximately 0.100 inches, an inner width of 0.080 inches and a depth of 0.100 inches. It is into one or the other of these gates 104, 106 that checker plate 124 must slide if the lock is to be opened. If button assembly 118 is not positioned so that one of gates 104, 106 can receive checker plate 124, then the checker plate will not be afforded enough freedom of travel, when moved by a knob 146 (FIGS. 1, 38–40), to retract bolt 128 from its locking position.

The relative position of checker 124 in the lock is constrained by the position of the buttons. If the button 102 is oriented to present a true gate to the checker, the checker can be slid downwardly a noticeable distance. This distance is sufficient to move bolt 128, which is normally coupled to the checker and moves therewith, to its unlocked position. If, on the other hand, button 102 is oriented so that it does not present a true gate to the checker, the checker (and consequently the bolt) is essentially prevented from moving.

Opposite true gates 104 and 106 are cut false gate 148, 150. False gates 148, 150 provide shallow recesses into which checker plate 124 can travel for a short distance, but do not afford the checker enough freedom of travel to effect an unlocking movement of the bolt. They are provided so that, regardless of whether a button assembly is in its "in" or "out" position, checker 124 will still engage a gate. If false gates 148, 150 were not provided, checker 124 could be urged against the side of a button and the button moved until the checker engaged a true gate. False gates 148, 150 thus give the impression that checker 124 is properly engaging a gate regardless of whether it is engaging the correct gate.

Figure 2:
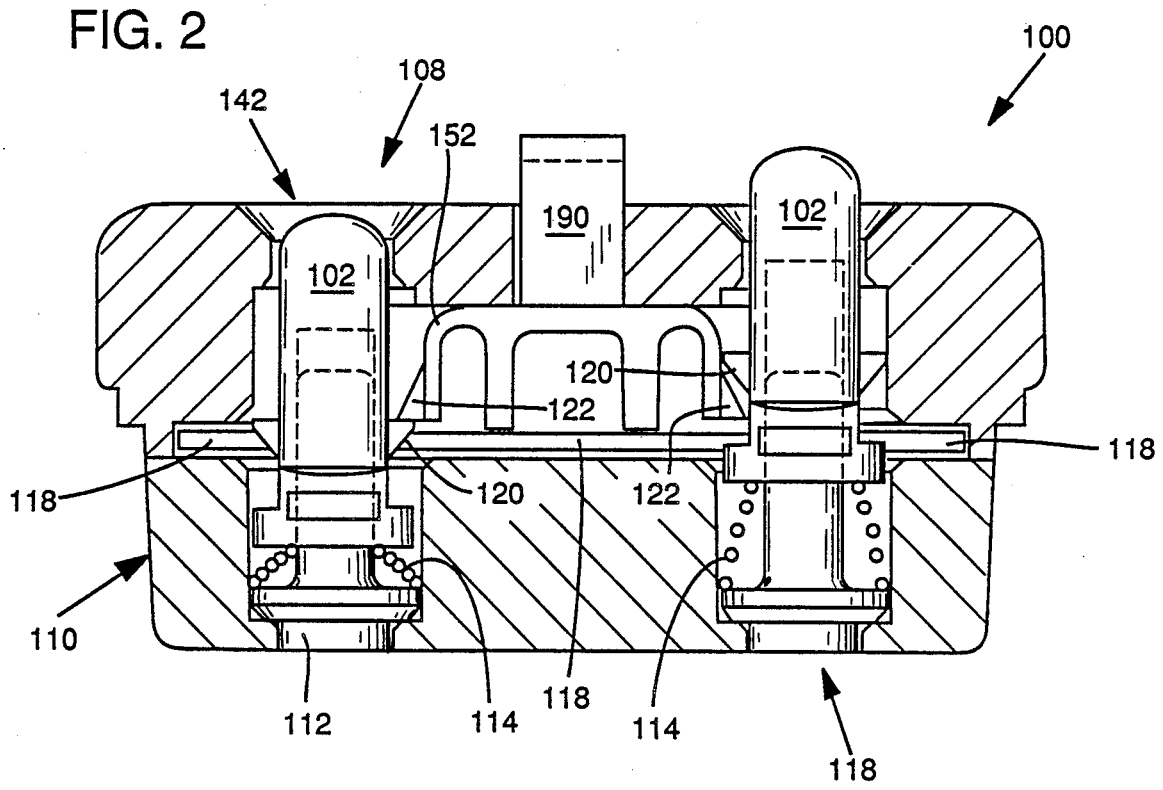
FIG. 2 is a section view of the lock of FIG. 1 showing one button assembly in its normal, "out," position and a second button assembly latched in a depressed, "down," position.

On the two sides of body portion 138 intermediate gates 106 and 150 are two small triangular protrusions 120. Protrusions 120 engage the triangular latching protrusions 122 on legs 152 of a plastic "centipede" member 154 and serve to hold button element 102 in its depressed position. The cooperative relationship between these triangular protrusions is illustrated in FIGS. 1 and 2.

FIGS. 6–9 show indicator element 112 of button assembly 118. Indicator element 112 includes an elongated front portion 156 having an irregular cross section (FIG. 9) that permits it to be received in only one orientation in hole 144 of button element 102. A rear portion 158 of indicator element 112 includes a circular boss 160 that occupies a hole 162 in a rear cover 164 (FIGS. 19–26) when indicator element 112 is urged against the rear cover by action of conical spring 114 on button element 102. When in this position, circular boss 160 is flush with the outer surface 166 of rear cover 164. A slot 168 in boss 160 can be engaged by a screwdriver to turn indicator element 112, and consequently button assembly 118, to the desired orientation. An indicating arrow 170 is painted or otherwise formed on boss 160 to indicate the orientation of button assembly 118 in case 110.

Adjacent boss 160 on indicator element 112 is a bevelled circular shoulder 172 having two notches 174 cut in the periphery thereof. Shoulder 172 is sized to be received in an area 176 of enlarged diameter (FIGS. 19, 23, 25) interior rear cover 164 from hole 162. (The bevelled edge 178 on shoulder 172 aids in guiding boss 160 into hole 162 and shoulder 172 into area 176). Into area 176 extend two keying protrusions 180 (FIGS. 19, 25) complementary to notches 174. When indicator element 112 is urged against rear cover 164 by conical spring 114, keying protrusions 180 cause indicator element 112, and consequently button assembly 118, to be oriented in one of two predetermined orientations when shoulder 172 seats in area 176. It is this orientation assumed by button assembly 118 that determines whether the corresponding button element must be in its "in" or "out" position for the lock to be opened.

Figure 6:
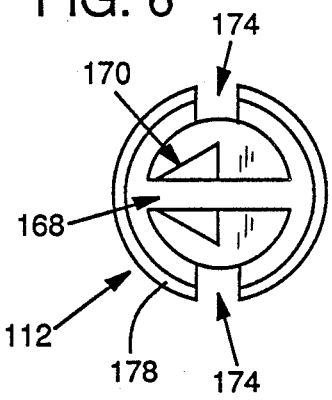
FIG. 6 is an rear end view of the indicator element of a button assembly.
Figure 7:
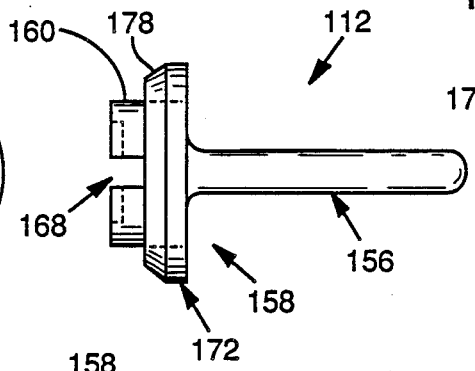
FIG. 7 is a side view of the indicator element of a button assembly.
Figure 9:
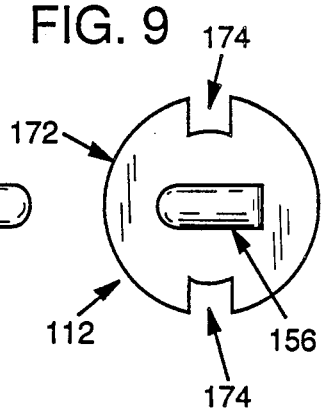
FIG. 9 is a front end view of the indicator element of a button assembly.
Figure 8:
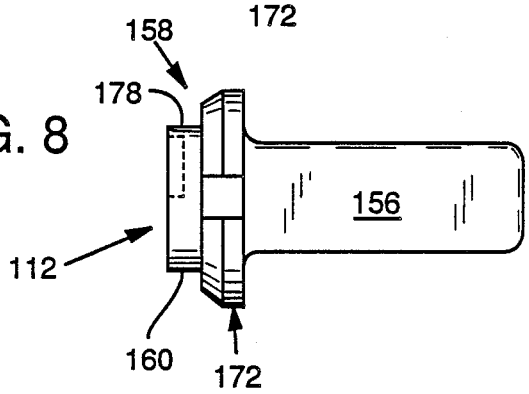
FIG. 8 is a side view of the indicator element of a button assembly orthogonal to the view shown in FIG. 7.

To change the orientation of button assembly 118, and thus to change the combination needed to open the lock, a screwdriver is applied to slot 168 and is used to push shoulder 172 inwardly against the force of spring 114. This action unkeys shoulder 172 from keying protrusions 180 and allows indicator element 112, and thus button assembly 118, to be turned to the opposite orientation. When the pressure applied by the screwdriver to indicator assembly 112 is then released, spring 114 causes shoulder 172 to reengage with keying protrusions 180, but this time in the opposite orientation. The resulting change in the internal orientation of button assembly 118 causes the positions of the false and true gates in button element 102 to be switched, thereby switching the "in" or "out" position required of button element 102 to open the lock. The internal orientation of button assembly 118 is indicated by arrow 170 which is visible on the back of the lock, as shown in FIG. 6. Instructions are provided to the user, as indicated at numeral 182 in FIG. 26, to correlate the orientation of arrow 170 with the button action needed to open the lock.

Figure 10:
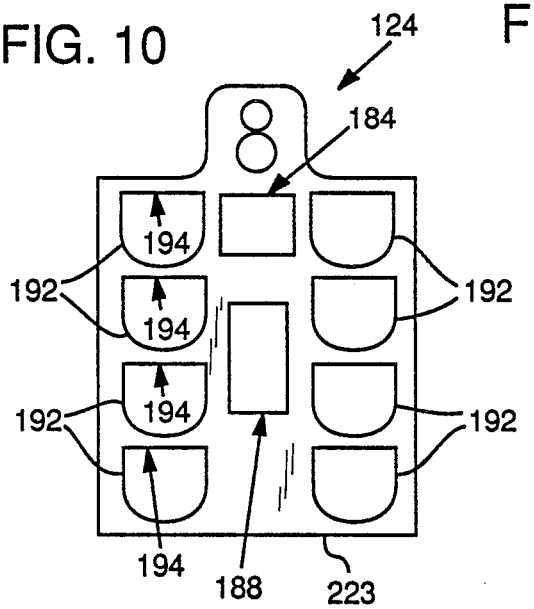
FIG. 10 is a plan view of the checker plate used in the lock of FIG. 1.
Figure 11:
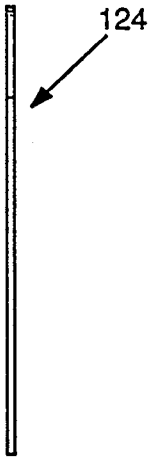
FIG. 11 is a side view of the checker plate of FIG. 10.
Figure 14:
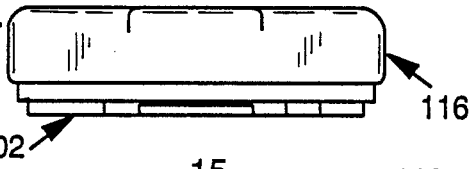
FIG. 14 is a top view of the front cover of FIG. 12.
Figure 13:
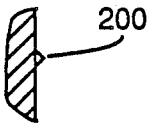
FIG. 13 is a detail showing one of the spacer cones formed in the front cover of FIG. 12.
Figure 12:
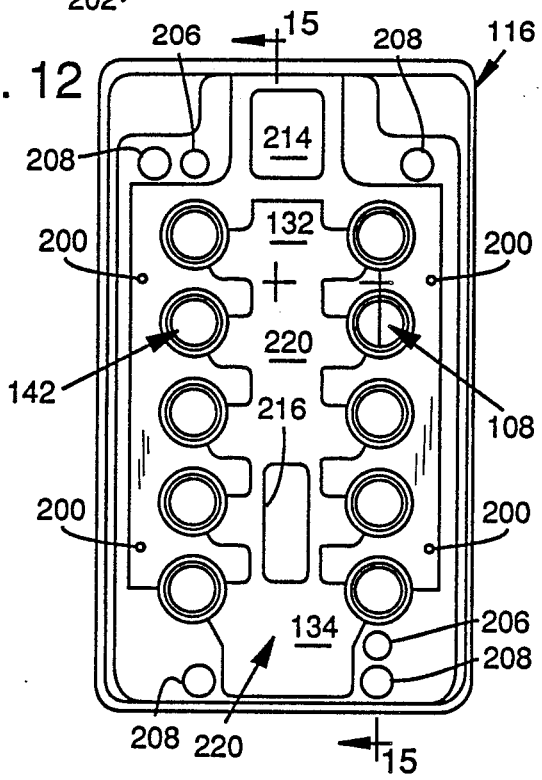
FIG. 12 is a rear plan view of the front cover used in the lock of FIG. 1.
Figure 15:
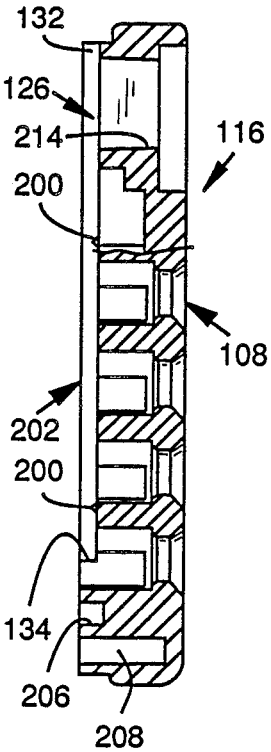
FIG. 15 is a section view taken on line 15—15 of FIG. 12.
Figure 16:
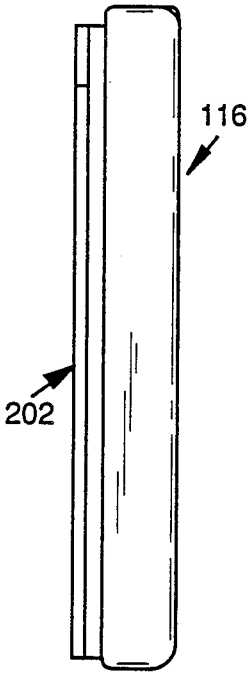
FIG. 16 is a side view of the front cover of FIG. 12.
Figure 17:
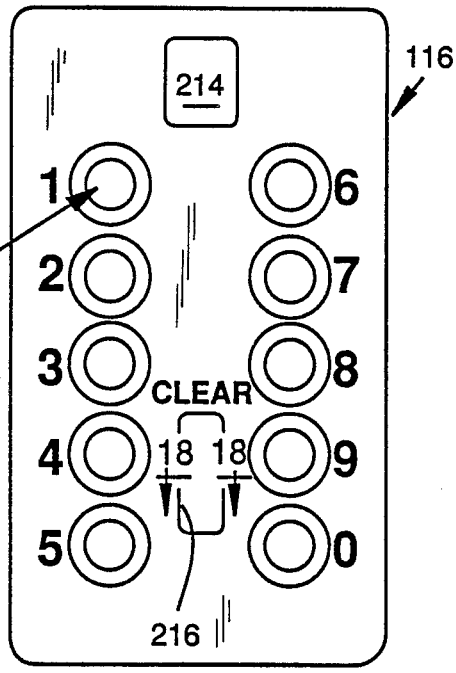
FIG. 17 is a front plan view of the front cover of FIG. 12.
Figure 18:
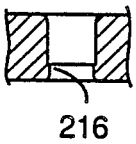
FIG. 18 is a section view taken on line 18—18 of FIG. 17.
Figure 20:
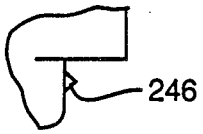
FIG. 20 is a detail showing one of the spacer cones formed in the rear cover of FIG. 19.
Figure 25:
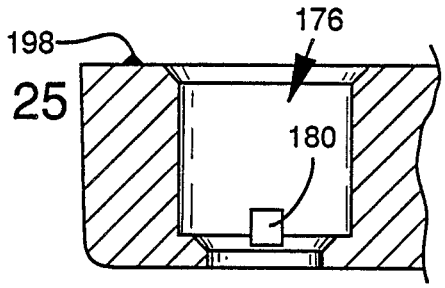
FIG. 25 is a section view taken on line 25—25 of FIG. 19.
Figure 22:
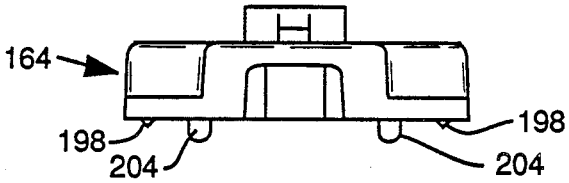
FIG. 22 is a top view of the rear cover of FIG. 19.
Figure 21:
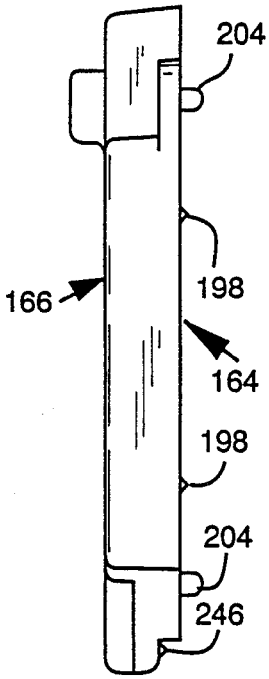
FIG. 21 is a side view of the rear cover of FIG. 9.
Figure 19:
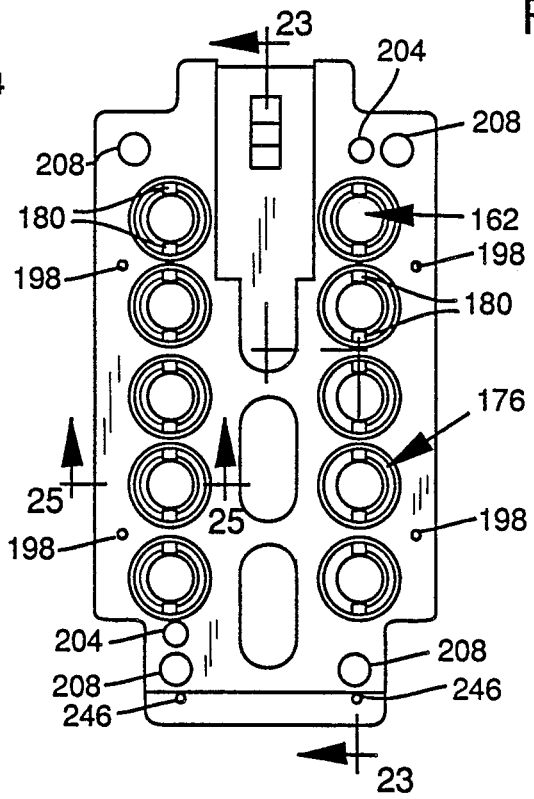
FIG. 19 is a rear plan view of the rear cover used in the lock of FIG. 1.
Figure 23:
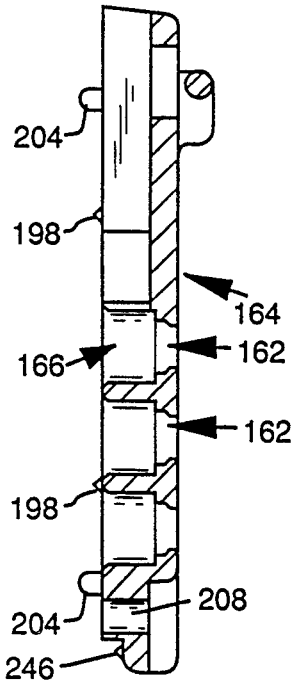
FIG. 23 is a section view taken on line 23—23 of FIG. 19.
Figure 24:
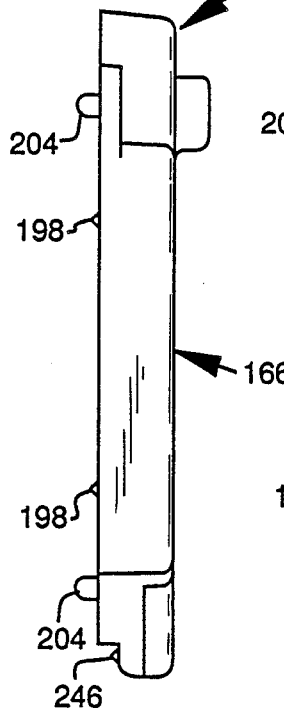
FIG. 24 is another side view of the rear cover of FIG. 19.
Figure 26:
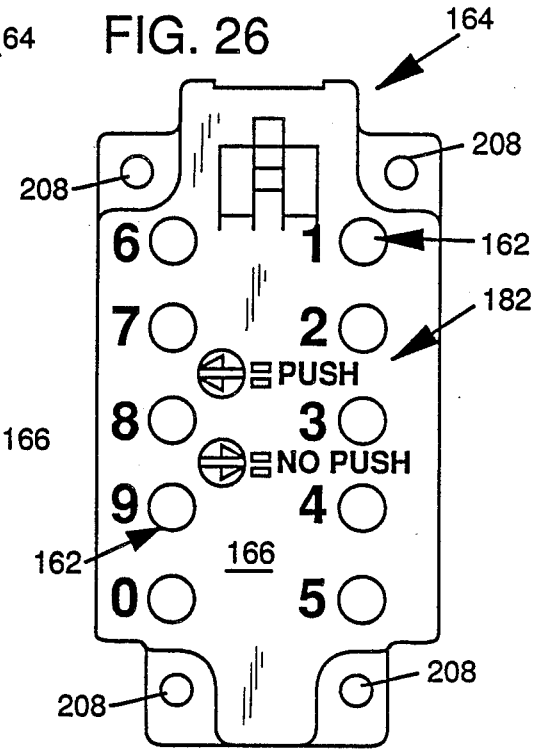
FIG. 26 is a front plan view of the rear cover of FIG. 19.
Figure 27:
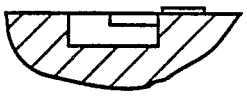
FIG. 27 is a sectional view showing a detail of FIG. 26.
Figure 28:
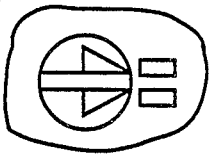
FIG. 28 is a plan view showing a detail of FIG. 26.
Figure 29:
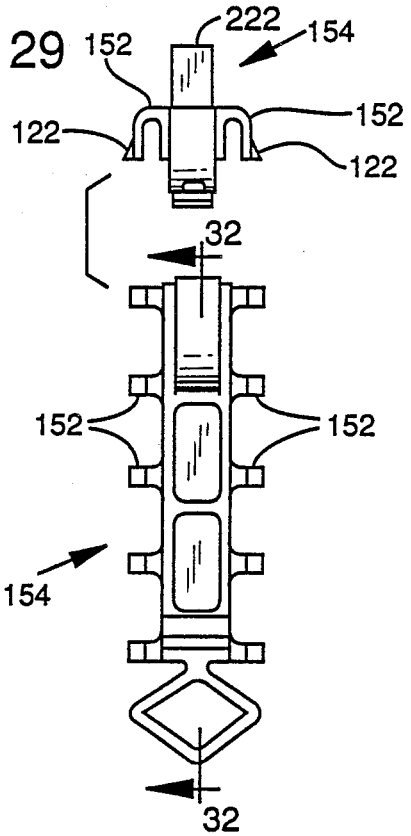
FIG. 29 is a top plan view of the centipede used in the lock of FIG. 1.
Figure 30:
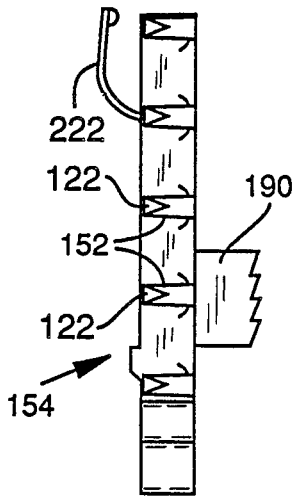
FIG. 30 is a side view of the centipede of FIG. 29.
Figure 31:
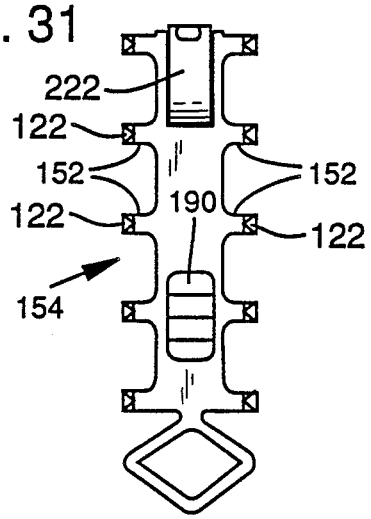
FIG. 31 is a bottom plan view of the centipede of FIG. 29.
Figure 32:
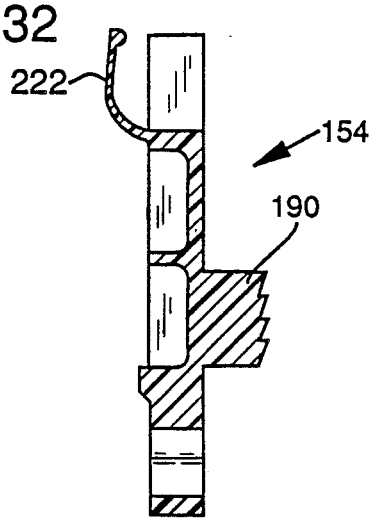
FIG. 32 is a section view taken on line 32—32 of FIG. 29.
Figure 33:
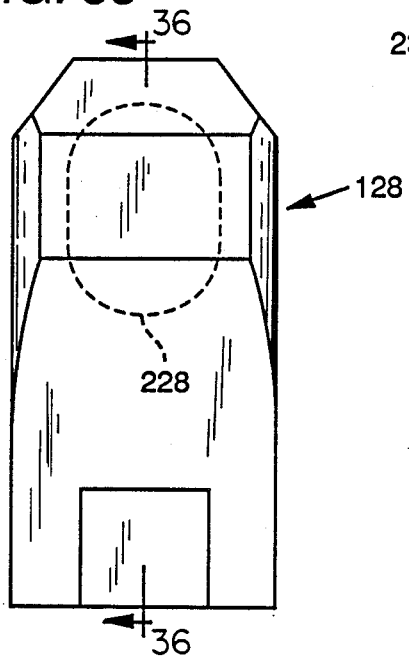
FIG. 33 is a front plan view of a locking bolt used in the lock of FIG. 1.
Figure 35:
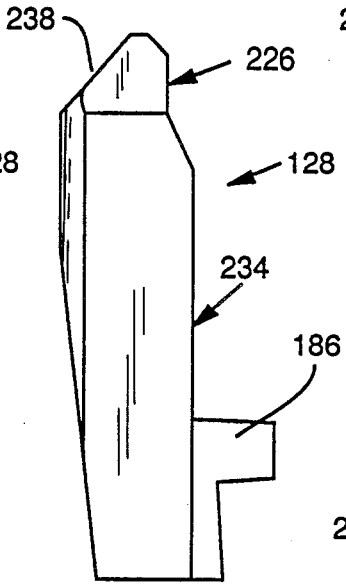
FIG. 35 is a side view of the bolt of FIG. 33.
Figure 36:
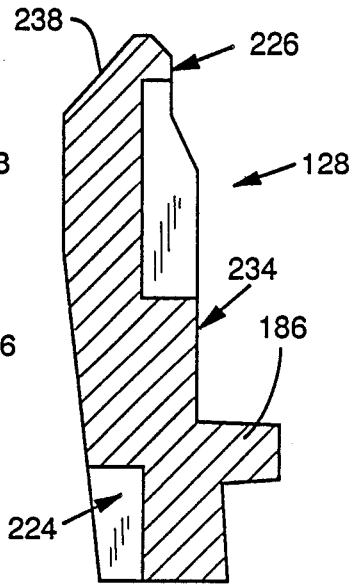
FIG. 36 is a section view taken on line 36—36 of the bolt of FIG. 33.
Figure 34:
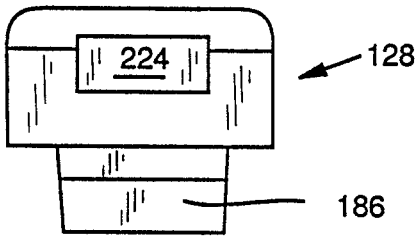
FIG. 34 is a bottom plan view of the bolt of FIG. 33.
Figure 37:
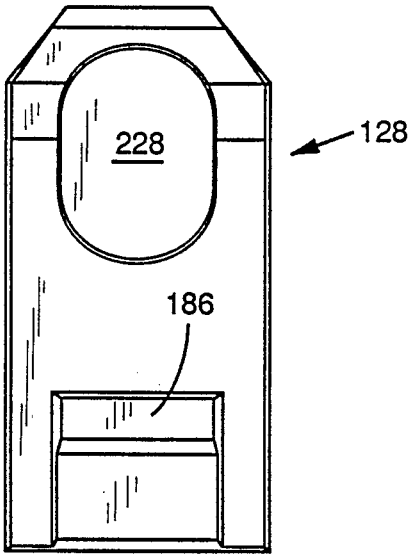
FIG. 37 is a rear plan view of the bolt of FIG. 33.

Referring now to FIGS. 10 and 11, checker 124 comprises a flat piece of metal having a plurality of openings cut therein. A first opening 184 normally receives a lower protruding lip 186 (FIGS. 35, 36) of bolt 128. (As described in more detail below, lower protruding lip 186 of bolt 128 is sometimes disengaged from first opening 184 when the bolt is tilted during closing of the lock.) A second opening 188 in checker 124 is provided to permit a "reset" button protrusion 190 (FIGS. 1, 2, 32) on centipede 154 to extend through the checker plate and out the front cover of the lock. Opening 188 is sized just large enough to pass reset button protrusion 190, so that if the reset button is operated, the checker is caused to move with it.

The remaining openings 192 in checker 124 allow button elements 102 to pass therethrough to the front of the lock. Equally important is that openings 192 define a plurality of edges 194 that act as plate tumblers to be received in the button elements' true gates. If lock 100 is to be opened, all of button elements 102 must be positioned so that they present a true gate towards the upper end of the lock so that the edges 194 that define openings 192 in the checker plate can be received in said gates. If even a single button element 102 is not properly positioned, checker 124 will not be able to move far enough through the buttons to retract bolt 128 to its unlocked position. While openings 192 are illustrated as being of irregular shape, they could alternatively be of any other shape, such as rectangular, provided they present edges which can be received in the gates of button elements 102. Finally it should be noted that illustrated checker 124 has only eight openings 192, while the illustrated lock employs ten button assemblies 118. The difference is reflected in the fact that two of the button assemblies, those positioned in the lowermost portion of the lock, rely on the lower edge of checker 124 itself for plate tumblers, as can be seen from the relative arrangement of parts depicted in the figures. In alternative embodiments, it is contemplated that checker 124 can take many shapes and forms, not limited to the planar configuration with openings illustrated here.

The rear cover 164 of lock 100, into which indicating elements 112 extend, is shown in FIGS. 19–28. The cover illustrated is designed to accommodate ten button assemblies, it being understood that the invention can be practiced with a greater or lesser number. From the planar inside surface 196 of cover 164 extend four small protrusions 198 which define a low friction bearing surface against which checker plate 124 slides. (Four corresponding protrusions 200 extend from the planar inside surface 202 of front cover 116 (FIGS. 12–13), the eight protrusions together defining the low friction track 126 within which checker plate 124 slides). Also protruding from planar inside surface 196 of rear cover 164 are two guide posts 204 which are adapted to be received in corresponding guide holes 206 (FIGS. 12, 15) in front cover 116 to align the front and rear covers in proper relationship. Finally, rear cover 164 includes four holes 208 at the corners thereof through which bolts 210 are passed and threaded into corresponding threaded holes 212 in front cover 116.

The upper portion of rear cover 164 defines a track 126 within which bolt 128 is received and within which it can slide. Bolt 128 is coupled to checker plate 124 by means hereinafter described.

The front cover 116 of lock 100, through which button elements 102 protrude, is shown in FIGS. 12–18 and includes first and second elongated openings 214, 216. First opening 214 permits a base portion 218 (FIG. 39) of unlocking knob 146 to be affixed therethrough to checker 124. Its elongation permits knob 146 to be moved downwardly to effect an unlocking operation. Second opening 216 permits "reset" button protrusion 190 on checker 124 to extend to the outside of case 110 and is likewise elongated to provide the reset button protrusion a downwardly extending range of travel. The plurality of holes 142 through which buttons 102 extend can be bevelled (FIGS. 1, 2, 15) so that the buttons can be pushed to "in" positions in which no part of the buttons is accessible above the plane defined by the lock's front surface. Alternatively, as shown in the figures, holes 142 can be left unbevelled.

Inner surface 202 of front cover 116 is recessed to define a substantially rectangular track 126 within which checker plate 124 slides. Front cover 116 is further cut out beneath track 126 to define an irregularly shaped elongated cavity 220 within which centipede 154 is positioned. The elongation of cavity 220 permits centipede 154 to slide up and down a short distance therein. Centipede 154 is normally biased to an upper position in cavity 220 by a coil spring which is compressed between the base end of the centipede and the bottom end 134 of the cavity. When in this normal, upper position, legs 152 of centipede 154 are adjacent the body portions 138 of button elements 102 and are in a position to latch in the "in" position any button elements 102 which may be depressed by a user, as shown in FIGS. 1 and 2. (This latching is effected by cooperation between triangular protrusions 120 and 122 as described earlier). If "reset" protrusion 190 of centipede 154 is pulled downwardly, the triangular protrusions 122 on the centipede which are holding the button elements in their "in" positions will be moved out of engagement with the button elements, permitting the button elements to return back to their "out" position under the influence of conical springs 114. Operation of the "reset" protrusion thus returns all of the button elements 102 to their "out" positions. As described more fully below, this resetting action occurs not only when resetting protrusion 190 is operated but also occurs every time the lock is opened and again every time the lock is closed.

Centipede 154 is coupled to checker plate 124 by a hook portion 222 that extends upwardly from the centipede and extends through hole 188 in the checker. Coupling is further effected by engagement between the bottom edge 223 of checker plate 124 and a protrusion 225 extending upwardly from centipede 154 (see FIG. 1). These linkages cause centipede 154 to move downwardly each time checker 124 moves downwardly. (This coupling, however, does not cause centipede 154 to move upwardly with checker 124 since neither of these coupling mechanisms is operative in the reverse direction. However, the spring that biases centipede 154 upwardly insures that the centipede returns to its upper position). Since checker 124 is caused to move downwardly when opening knob 146 is operated to open the lock, this opening action causes centipede 154 to move downwardly also, resetting button elements 102 to their "out" positions. Likewise, when the lock is closed from its open position to its closed position, bolt 128 retracts back into case 110 by the bolt's tilt bolt feature (described in more detail below) and causes button elements 102 to be reset. As shown in FIG. 1, bolt 128 is coupled to centipede 154 by engagement of hook portion 222 of the centipede in a shoulder portion 224 of the bolt. Consequently, the downward motion of bolt 128 when the lock is closed urges centipede 154 downwardly, again releasing buttons 102 to their "out" positions.

Bolt 128 employed in the lock of the present invention is shown in FIGS. 33–37 and includes an upper, latching portion 226, a lower, protruding lip portion 186 and a hole 228 extending therethrough. Latching portion 226 abuts a fixed member to secure the lock in its locked state. Hole 228 permits a bolt 232 to be threaded into opening knob 146 through a hole 234 in checker 124 to as to rigidly connect the opening knob to the checker.

Lower protruding lip portion 186 of bolt 128 is an element of the tilt bolt lock feature employed in this invention. Tilt bolt locks are described in U.S. Pat. No. 4,626,007, the disclosure of which is incorporated herein by reference. One of the features of tilt bolt locks is that the bolts thereof are permitted to retract into their cases when the lock is closed, regardless of the state of the lock's internal locking components. This is effected by removably coupling the bolt to an element of the lock, here checker 124, in a manner that depends for its coupling on the coplanar adjacency of the bolt and the element of the lock. This coplanar adjacency is here effected by urging a planar portion 234 of the bolt against a planar upper region on checker 124 by spring action provided by resilient hook 222. As can be seen in FIG. 1, when the parts are arranged in this manner, lower protruding lip portion 186 is urged into an upper hole 184 in checker 124, thereby securely coupling these elements together. Thus, bolt 128 is prevented from retracting to a lower position unless checker 124 is similarly moved, when these parts are in the position illustrated.

Referring still to FIG. 1, when lock 100 is opened, bolt 128 is retracted and the lock assembly is moved to the right. When it is thereafter desired to close the lock, the lock including bolt 128 is moved back towards the left until the bolt abuts the element behind which it will ultimately latch. This abutment causes bolt 128 to tend to pivot in a clockwise manner about a point 236. This pivoting or tilting action causes lower protruding lip portion 186 to disengage hole 184 in checker 124, freeing the bolt from the checker's constraint. With bolt 128 disengaged from checker 124, the bolt is free to be urged downwardly by action of abutting the element 230 on an inclined surface 238 of the bolt. This downward movement of bolt 128 continues until the bolt can slip under the element against which it is secured. At this point, the torque that had caused the bolt to tilt is removed and the bolt is urged upwardly by the engagement between hook portion 222 of centipede 154 with shoulder 224 on the bolt. After the bolt travels upwardly a distance, its lower protruding lip portion 186 reenters opening 184 in the checker under the spring force applied by resilient hook portion 222, and is urged therein under the influence of resilient hook 222, thereby returning the bolt to its normal, fixed position.

From the foregoing it will be recognized that the illustrated arrangement permits the lock to be closed (and the bolt to then retract) regardless of the positions of the pushbuttons. Furthermore, the closing action itself releases buttons 102 to their "out" positions. Finally, the tilt bolt feature also renders the lock immune to opening by a shock force, a problem which plagues locks employing spring-loaded locking bolts which may be shocked back to their retracted positions under the force of their own inertia.

FIGS. 29–32 show an alternative arrangement for centipede 154 in which the spring which biases the centipede upwardly in cavity 220 is formed as an integral part of the plastic centipede itself.

Figure 38:
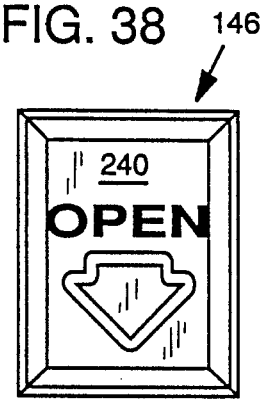
FIG. 38 is a front plan view of the unlocking knob used in the lock of FIG. 1.
Figure 39:
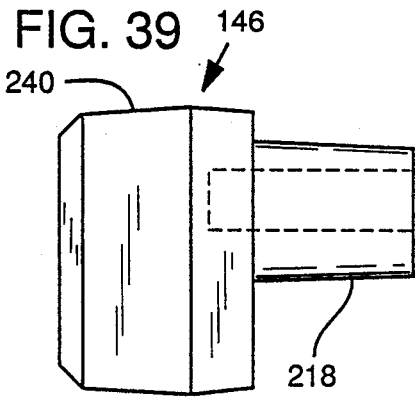
FIG. 39 is a side view of the knob of FIG. 38.
Figure 40:
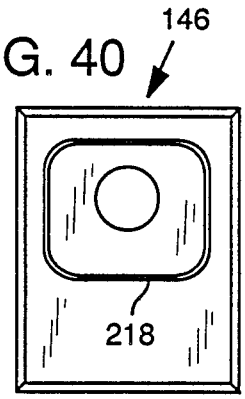
FIG. 40 is a rear plan view of the knob of FIG. 38.

Unlocking knob 146 is shown in FIGS. 38–40 and includes a front portion 240 for gripping by a user and a rear base portion 218 which is bolted to checker 124. If buttons 102 are in the proper unlocking positions, knob 146 can be urged downwardly to open the lock.

Having described and illustrated the principles of our invention in an illustrative embodiment, it should be apparent to those skilled in the art that the invention can be modified in detail and arrangement without departing from such principles. Accordingly, we claim as our invention all modifications as may come within the scope and spirit of the following claims and equivalents thereof.

We claim:

1. In a pushbutton lock comprised of:

a case;

a plurality of pushbutton assemblies, each of said assemblies having a gate in a side therein;

a case defining a plurality of bores within which the button assembles can travel, said case having holes in a front portion thereof through which first end portions of the button assemblies can extend and having holes in a rear portion thereof through which second end portions of the button assembles can be accessed;

spring means for urging the first end portions of the button assemblies through the front portion of the case;

a locking bolt;

a plate defining a plurality of edges for engaging the sides of the button assemblies and for being received in the gates therein if the button assemblies are properly positioned, said plate being coupled to the bolt;

actuator means coupled to the plate for moving the plate and bolt to an unlocked position if the gates in the button assemblies are positioned to receive the edges of the plate therein;

an improvement wherein:

the case includes antirotation means for selectively preventing the rotation of the button assemblies within the case, said means comprising keying protrusions on the case that extend radially inwardly from peripheral sidewalls of the holes in the rear of the case and normally engage with complementary notches which extend radially inwardly from peripheries of the second end portions of each of the pushbutton assemblies, said engagements being maintained by action of the aforesaid spring means, said antirotation means permitting the button assemblies within the case to be selectively rotated to allow recoding of the lock if the second end portions of the button assemblies are first pushed towards the front portion of the case through the holes in the rear portion thereof, against the force of the spring means.

2. The lock of claim 1 in which the portion of each pushbutton assembly that protrudes through the front portion of the case is round in cross section.

* * * * *